US006530437B2

(12) United States Patent
Maurer et al.

(10) Patent No.: US 6,530,437 B2
(45) Date of Patent: Mar. 11, 2003

(54) MULTI-GRADIENT DRILLING METHOD AND SYSTEM

(75) Inventors: William C. Maurer, Houston, TX (US); George H. Medley, Jr., Spring, TX (US); William J. McDonald, Houston, TX (US)

(73) Assignee: Maurer Technology Incorporated, Sugar Land, TX (US)

( * ) Notice: Subject to any disclaimer, the term of this patent is extended or adjusted under 35 U.S.C. 154(b) by 0 days.

(21) Appl. No.: 09/874,179

(22) Filed: Jun. 5, 2001

(65) Prior Publication Data

US 2002/0011338 A1 Jan. 31, 2002

Related U.S. Application Data

(60) Provisional application No. 60/210,419, filed on Jun. 8, 2000.

(51) Int. Cl.[7] ..... E21B 21/01

(52) U.S. Cl. ..... 175/5; 175/65; 175/206; 175/207; 166/310

(58) Field of Search ..... 166/367, 310, 166/75.12, 372, 267; 175/65, 5, 207, 54, 206

(56) References Cited

U.S. PATENT DOCUMENTS

| | | | | |
|---|---|---|---|---|
| 3,815,673 A | | 6/1974 | Bruce | 166/5 |
| 4,099,583 A | | 7/1978 | Maus | 175/7 |
| 4,291,772 A | | 9/1981 | Beynet | 175/5 |
| 4,423,791 A | | 1/1984 | Moses, Jr. | 175/65 |
| 5,839,520 A | | 11/1998 | Maillet | 175/61 |
| 6,035,952 A | * | 3/2000 | Bradfield et al. | 175/207 |

FOREIGN PATENT DOCUMENTS

| | | |
|---|---|---|
| GB | 1574797 | 9/1980 |

OTHER PUBLICATIONS

Nakagawa et al., Application of aerated–fluid drilling in deep water; World Oil, June 1999, pp. 47–50.

Medley et al., Use of Hollow Glass SPheres for Underbalanced Drilling Fluids, Society of Petroleum Engineers; Oct. 22, 1995, pp. 511–520.

* cited by examiner

*Primary Examiner*—David Bagnell
*Assistant Examiner*—Jennifer R. Dougherty
(74) *Attorney, Agent, or Firm*—Pillsbury Winthrop LLP

(57) ABSTRACT

A multi-gradient system for drilling a well bore from a surface location into a seabed includes an injector for injecting buoyant substantially incompressible articles into a column of drilling fluid associated with the well bore. Preferably, the substantially incompressible articles comprises hollow substantially spherical bodies.

86 Claims, 5 Drawing Sheets

MULTI-GRADIENT DRILLING METHOD AND SYSTEM

CROSS-REFERENCE TO RELATED APPLICATION

The present application claims the benefit of U.S. Provisional Application Serial No. 60/210,419, filed Jun. 8, 2000, and titled Ultra Lightweight Cement.

This invention was made with Government support under Contract No. DE-AC21-94MC31197 awarded by the Department of Energy. The Government has certain rights in this invention.

FIELD OF THE INVENTION

The present invention relates generally to the field of offshore oil and gas drilling, and more particularly to a method of and system for drilling offshore oil and gas wells in which buoyant substantially incompressible articles are injected into the drilling fluid column at one or more injection points to reduce the density of drilling fluid column above the injection point or points, thereby to adjust or alter the drilling fluid pressure gradient over selected portions of the drilling fluid column.

BACKGROUND OF THE INVENTION

With conventional offshore drilling, a riser extends from the sea floor to a drill ship. As is well known in the art, drilling fluid is circulated down the drill stem and up the borehole annulus, the casing set in the borehole, and the riser, back to the drill ship.

The drilling fluid performs several functions, including well control. The weight or density of the drilling fluid is selected so as to maintain well bore annulus pressure above formation pore pressure, so that the well does not "kick", and below fracture pressure, so that the fluid does not hydraulically fracture the formation and cause lost circulation. In deep water, the pore pressure and fracture pressure gradients are typically close together. In order to avoid lost circulation or a kick, it is necessary to maintain the drilling fluid pressure between the pore pressure gradient and the fracture pressure gradient.

With conventional riser drilling, the drilling fluid hydrostatic pressure gradient is a straight line extending from the surface. This hydrostatic pressure gradient line traverses across the pore pressure gradient and fracture pressure gradient over a short vertical distance, which results in having to set numerous casing strings. The setting of casing strings is expensive in terms of time and equipment.

Recently, there have been proposed systems for decoupling the hydrostatic head of the drilling fluid in the riser from the effective and useful hydrostatic head in the well bore. Such systems are referred to as dual gradient drilling systems. In dual gradient systems, the hydrostatic pressure in the annulus at the mud line is equal to the pressure due to the depth of the seawater and the pressure on the borehole is equal to the drilling fluid hydrostatic pressure. The combination of the seawater gradient at the mud line and drilling fluid gradient in the well bore results in greater depth for each casing string and a reduction of the total number of casing strings required to achieve any particular bore hole depth.

There have been suggested three mechanisms to achieve dual gradient system. One suggested mechanism is continuous dumping of drilling fluid returns at the sea floor. This suggested mechanism is neither environmentally practical nor economically viable.

The second suggested mechanism is gas lift, which involves injecting a gas such as nitrogen into the riser. Gas lift offers some advantages in that it requires no major subsea mechanical equipment. However, there are some limitations associated with gas lift. Since gas is compressible, there are limitations on the depth at which it may be utilized and extensive surface equipment may be required. Additionally, because the gas expands as the drilling fluid reaches the surface, surface flow rates can be excessive.

The third suggested mechanism to create a dual gradient system is pumping the drilling fluid from the underwater wellhead back to the surface. Several pumping systems have been suggested, including jet style pumps, positive displacement pumps, and centrifugal pumps. Sea floor pump systems provide the flexibility needed to handle drilling situations, but they have the disadvantage of high cost and reliability problems associated with keeping complex pumping systems operating reliably on the sea floor.

SUMMARY OF THE INVENTION

The present invention provides a multi-gradient method of and system for drilling a well bore. Briefly stated, the system of the present invention injects buoyant substantially incompressible articles at one or more injection points into the column of drilling fluid associated with the well bore. An injection point may be positioned in a marine riser connected between a subsea wellhead and a surface drilling location, a cased section of the well bore, or an open hole section of the well bore. Preferably, the substantially incompressible articles comprises hollow substantially spherical bodies.

In one embodiment, a conduit is connected between the surface location and an injection point in the riser. A slurry containing the substantially incompressible articles is injected into the conduit at the surface location. In one embodiment, the slurry comprises a mixture of the substantially incompressible articles and drilling fluid. The drilling fluid may be of the same weight and composition as the primary drilling fluid being circulated in the well bore, or it may be of a lesser weight. The drilling fluid and incompressible article slurry may be injected directly into the riser. Alternatively, the incompressible articles may be separated from the drilling fluid prior to injection, thereby to increase the concentration of incompressible articles injected to into the riser. The separated drilling fluid is returned to the surface.

The slurry may alternatively comprise a mixture of the substantially incompressible articles and water. In the water slurry embodiment, the means for injecting the substantially incompressible articles includes means for separating the substantially incompressible articles from the water prior to injecting the substantially incompressible articles into the riser. In one embodiment, the means for separating the substantially incompressible articles includes a vessel positioned adjacent the injection point. The vessel is gas-pressurized to form a water-gas interface. A slurry inlet is positioned in the vessel below the water-gas interface and coupled to the conduit. A water outlet is positioned in the vessel below the water-gas interface. An article outlet positioned in the vessel above the water-gas interface and coupled to the injection point.

The system of the present invention may include means for recovering the incompressible articles from the drilling fluid returned to the surface location from the riser. In one embodiment, the means for separating the incompressible articles from the drilling fluid includes a screen device for separating the incompressible articles and drill cuttings from the drilling fluid. The screen device has a mesh size and the incompressible articles are larger than the mesh size. The system of the present invention further includes means for separating the incompressible articles from the drill cuttings. The means for separating the incompressible articles from the drill cuttings may include a water-filled vessel positioned to receive the incompressible articles and the drill cuttings from the screen device. The drill cuttings sink and the substantially incompressible articles float, thereby allowing the substantially incompressible articles to be recovered from the surface of the water in the vessel.

In an alternative embodiment, the incompressible articles are mixed with the primary drilling fluid. The mud pumps pump the mixture of incompressible articles and primary drilling fluid down the drill string to an internal injection point defined by a drill string separation and injection device positioned in the drill string near the depth of the seabed. The drill string separation and injection device separates the incompressible articles from the drilling fluid and injects the separated articles into the riser. The separated drilling fluid continues down the drill string to the bit and back up the annulus to the riser, where it mixes with the with the incompressible articles for return to the surface. The drill string injection method does not require that the incompressible articles be separated from the drilling fluid returned to the surface.

Preferably, the substantially incompressible articles are injected into the drilling fluid column at a rate sufficient to reduce the density of drilling fluid above the injection point to a predetermined density. The density p of the drilling fluid in the column is determined according to the equation $$p = \frac{(100 - v)p_f + vp_s}{100}$$

where $p_f$ is drilling fluid density without the substantially incompressible articles;

$p_s$ is the density of the substantially incompressible articles; and v is the concentration of the substantially incompressible articles. In the drilling fluid slurry embodiment of the present invention, the density p of drilling fluid in the riser is determined according to the equation $$p = \frac{p_m Q_m + p_s Q_s}{Q_m + Q_s}$$

Where $p_m$ is the drilling fluid density without the substantially incompressible articles;

$p_s$ is the density of the slurry;

$Q_m$ is the drilling fluid flow rate; and, $Q_s$ is the slurry flow rate.

DETAILED DESCRIPTION

Figure 1:
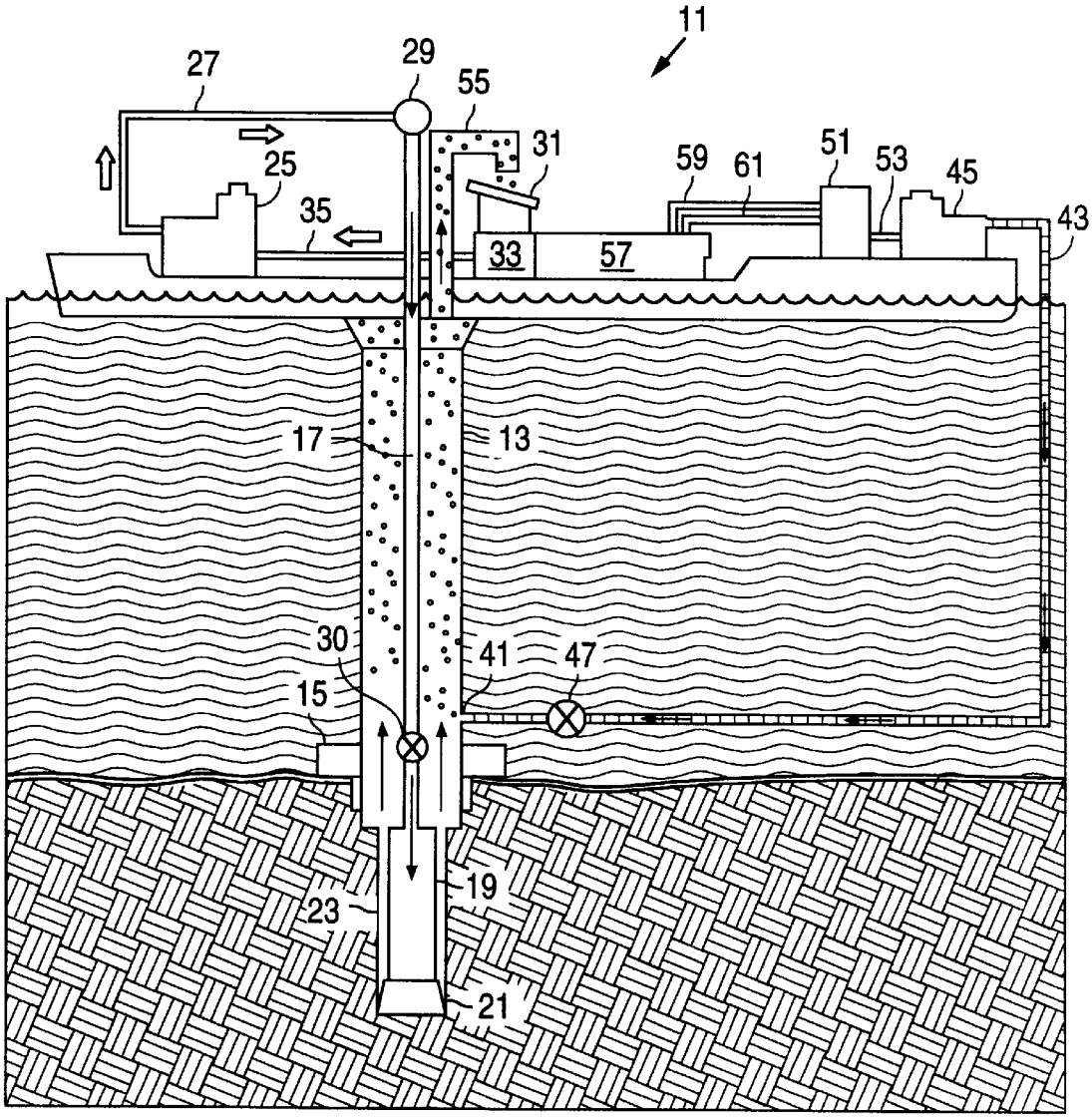
FIG. 1 is a schematic view of a system according to the present invention.

Referring now to the drawings, and first to FIG. 1, a drill ship, or other suitable offshore drilling platform, is designated generally by the numeral 11. As will be apparent to those skilled in the art, the figures of the present invention are diagramatic in nature and not drawn to scale. Drill ship 11 is adapted to perform offshore drilling in the manner known to those skilled in the art. A marine riser 13 is shown connected between drill ship 11 and underwater wellhead and blow out preventer stack indicated generally at 15.

Drill ship 11 accomplishes drilling by means of a string of drill pipe 17 connected from the surface to a bottom hole assembly 19, which in turn is connected to a drill bit 21. Suitable lifting gear (not shown) is provided on drill ship 11 for lifting and lowering drill pipe 11 so as to apply weight to bit 21. Additionally, rotary equipment (not shown), such as a rotary table or top drive, is provided in drill ship 11 to rotate bit 21.

In the manner known to those skilled in the art, drilling fluid is circulated down drill pipe 17 and bottom hole assembly 19 through bit 21 and up bore hole 23 and riser 13 back to drill ship 11. The drilling fluid circulation system includes a mud pump 25. The outlet of mud pump 25 is connected to a conduit 27, which in turn is connected to drill pipe 17 through a swivel 29.

According to the present invention, the drilling fluid in riser 13 is lighter than the drilling fluid in the annulus or in drill string 17. Pressure at the bottom of drill string 17 is greater than the annulus pressure at the bottom of bore hole 23. The bottom hole pressure differential can result in fluid flow due to u-tubing when mud pump 25 is turned off, for example when adding joints of drill pipe to drill string 17. Accordingly, a drill string valve 30 may be included in drill string 17 to prevent fluid flow when mud pump 25 is turned off. Drill string valve 30 must allow flow with minimal pressure loss when drilling fluid is being pumped down drill string 17 while preventing flow when mud pump 25 is turned off.

Drilling fluid returned to drill ship 11 through riser 13 is cleaned with a solid separation system that includes a conventional shale shaker 31. Clean drilling fluid is collected in a tank 33, which is connected to the inlet of mud pump 25 by a conduit 35.

According to the present invention, a system is provided for injecting buoyant incompressible articles into riser 13 near wellhead 15. In the drawings, the incompressible articles are depicted as small circles. In the preferred embodiment the buoyant substantially incompressible articles comprise substantially spherical articles having a diameter greater than about 100 microns so as to be separable from drilling fluid with a conventional 100-mesh shale shaker screen. Preferably the articles have a density less than about 0.50 gm/cm$^3$ (4.17 pounds per gallon (ppg)). Also, the articles should have sufficient strength so as to withstand the pressures encountered at the maximum water depth in which the system of the present invention is used. Examples of suitable articles are Scotchlite™ glass bubbles manufactured by the 3M Company and Minispheres™ such as those available from Balmoral Group International, Inc. Houston, Tex. The Scotchlite™ glass bubbles have densities of about 0.38 gm/cm$^3$ (3.17 ppg) and service depths up to about 9000 feet. The Minispheres™ are hollow generally spherical bodies, typically 10 mm (0.39 inches) in diameter, that are manufactured from fiber reinforced epoxy resin. Carbon fiber Minispheres™ range in density from about 0.43 gm/cm$^3$ (3.59 ppg)to about 0.66 gm/cm$^3$ (5.50 ppg) and have service depths of up to 15,000 feet.

According to the present invention, the incompressible articles are injected into riser 13 in a drilling fluid or seawater slurry. The slurry is pumped from drill ship 11 to an injection point 41 in riser 13 through a conduit 43 connected to the outlet of a pump 45, which may be a conventional mud pump. An appropriate valve or injection system 47 is positioned in conduit 43 adjacent injection point 41.

The slurry is preferably mixed in a mixing tank 51 connected to the inlet of pump 45 by a conduit 53. As will be discussed in detail hereinafter, the composition of the slurry and the injection rate of the articles into riser 13 are controlled so as to achieve a desired drilling fluid density in riser 13. As the articles are injected into riser 13 the incompressible articles mix with the drilling fluid in riser 13, thereby reducing the density of the fluid in riser 13 above injection point 41.

The mixture of drilling fluid and articles flows upwardly in riser 13 toward drill ship 11 to a diverter. The drilling fluid, with articles and drill cuttings, is carried from the diverter through a conduit 55 to shale shaker 31. Shale shaker 31 separates the articles and drilled solids from the drilling fluid. The clean drilling fluid flows through shale shaker 31 into drilling fluid tank 33 and the articles and drill solids travel off shale shaker 31 into a separation tank 57. The incompressible articles are collected from separation tank 57 and conveyed to mixing tank 51 through a conduit 59. In the drilling fluid slurry embodiment of the present invention, drilling fluid may be supplied to mixing tank 51 through a conduit 61 connected to drilling fluid tank 33 or to a separate source of drilling fluid, such as "base mud." In the seawater slurry embodiment of the present invention, conduit 61 is connected to a source of seawater.

Figure 2:
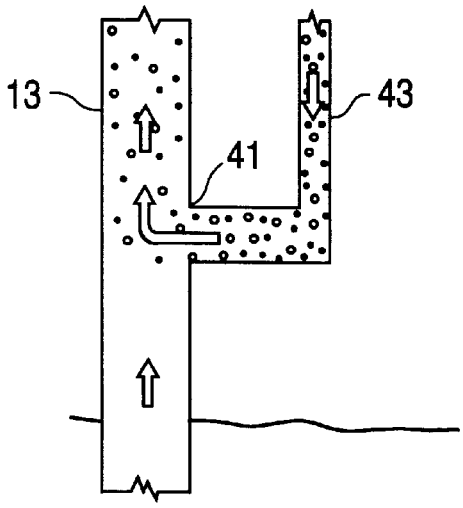
FIG. 2 illustrates a drilling fluid slurry injection system according to the present invention.

Referring now to FIG. 2, there is shown details of a drilling fluid slurry injection system according to the present invention. As shown in FIG. 2, conduit 43 is connected to riser 13 at injection point 41. The slurry of incompressible articles and drilling fluid is simply injected into riser 13 at injection point 41. The pressure provided by pump 45 (FIG. 1) is selected so as to be greater than the hydrostatic pressure in riser 13 at injection point 41. A suitable check valve (not shown in FIG. 2) is provided in conduit 43 so that drilling fluid does not back flow in conduit 43.

According to the present invention, the drilling fluid used to make the slurry may be lighter than the drilling fluid in the primary drilling fluid system. Due to dilution, the lighter the drilling fluid of the slurry, the more the density of the drilling fluid in riser 13 can be reduced. The weight of the slurry fluid can be reduced by removing weighting material from the primary drilling fluid prior to forming the slurry. Alternatively, a separate lightweight base mud slurry fluid may be formulated. In either event, the primary drilling fluid must be properly weighted prior to being pumped back down the drill string.

Figure 3:
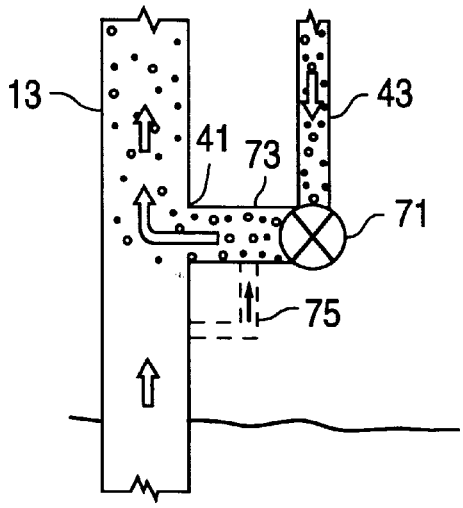
FIG. 3 illustrates a sea water fluid slurry injection system according to the present invention.

Referring now to FIG. 3, there is shown a seawater slurry injection system according to the present invention. Conduit 43 provides a mixture of seawater and articles via a separation and injection system, indicated generally at 71. System 71 will be described in detail with respect to FIGS. 4 and 5. The output of system 71 is connected to injection point 41 by a suitable conduit 73. Drilling fluid may be diverted from riser 13 to conduit 43 or system 71 through a suitable conduit shown in phantom at 75.

Figure 4:
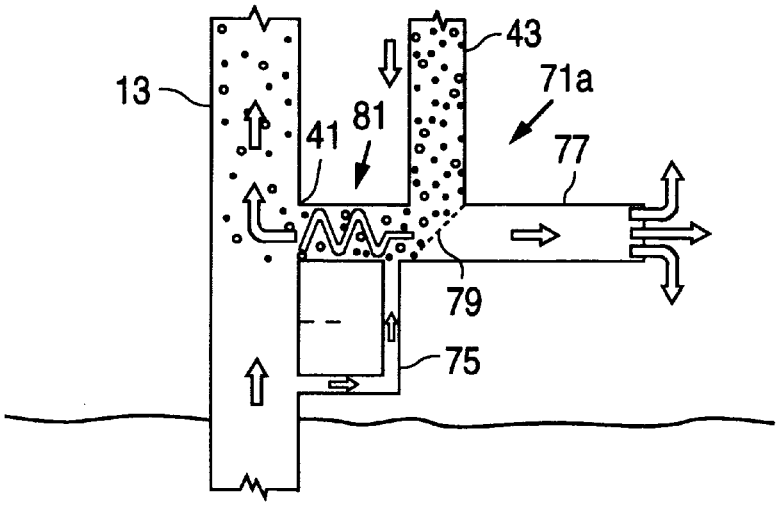
FIG. 4 illustrates details of one sea water fluid slurry injection system according to the present invention.

Referring now to FIG. 4, there is shown one embodiment of a seawater slurry injection system according to the present invention. In FIG. 4, the separation and injection system, indicated at 71*a*, includes a diverter conduit 77 connected to slurry conduit 43. A screen 79 having a mesh size smaller than the diameter of the incompressible articles is disposed between slurry conduit 43 and diverter conduit 77. Screen 79 separates the articles from the seawater. The seawater is discharged through the diverter conduit 77.

The separated articles are forced to the inlet of a pump, which in the illustrated embodiment is a Moineau pump, indicated generally at 81. Moineau pumps are well known to those skilled in the art and they include a progressive cavity pump with a helical gear pair wherein one of the gears is a rotor and the other is a stator. The outlet of Moineau pump 81 is connected to injection point 43. Conduit 75 is connected to the inlet of Moineau pump 81 to supply drilling fluid from riser 13 to the inlet of Moineau pump 81. Moineau pump 81 may be powered by the fluid pumped down conduit 43 with the articles, thereby eliminating the need for separate electric or hydraulic lines from the surface. Moineau pump 81 forms a slurry of drilling fluid and incompressible articles and injects that slurry into riser 13 at injection point 41. While pump of the illustrated embodiment is Moineau pump, those skilled in the art will recognize that any suitable pump, such as vane, piston, diaphragm, centrifugal, etc. pumps, may be used according to the present invention.

Figure 5:
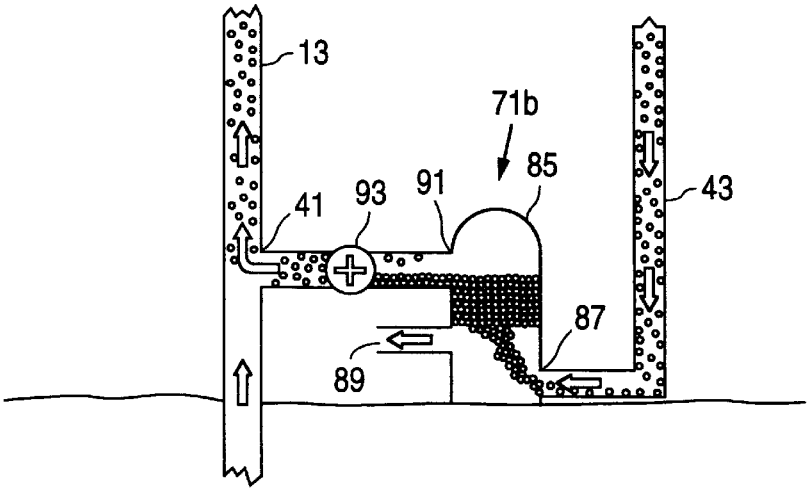
FIG. 5 illustrates details of an alternative sea water fluid slurry injection system according to the present invention.

According to FIG. 5 there is shown an alternative injection system 71*b*. Injection system 71*b* includes a vessel 85 positioned near the seafloor adjacent injection point 41. Vessel 85 includes a slurry inlet 87 connected to receive the sea water slurry from conduit 43. Vessel 85 includes a seawater outlet 89 positioned vertically above inlet 87. Vessel 85 also includes an article outlet 91 positioned vertically above seawater outlet 89. Vessel 89 is partially gas pressurized so as to form a gas/water interface above seawater outlet 89. As illustrated in FIG. 5, the seawater slurry flows into vessel 85 at inlet 87. The incompressible articles, being buoyant, flow upwardly in vessel 85 toward the gas/water interface thereby separating themselves from the seawater. The separated seawater flows out of vessel 85 through seawater outlet 89. The incompressible articles are collected and injected into riser 13 by a suitable injector indicated generally at 93. Injector 93 may be a Moineau pump or the like.

Figure 6:
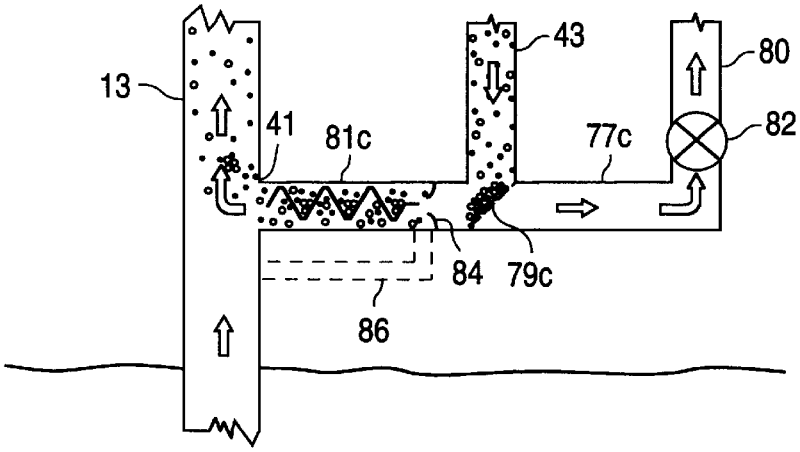
FIG. 6 illustrates details of an alternative drilling fluid slurry injection system according to the present invention.

Referring now to FIG. 6, there is illustrated an alternative separation and injection system according to the present invention in which the articles are pumped from the surface in drilling fluid slurry, wherein the drilling fluid may be of the same composition and weight as the primary drilling fluid or it may be base mud. Base mud is a mixture of water or synthetic oil containing no weighting material. The separation and injection system of FIG. 6 is similar to the seawater slurry injection system illustrated in FIG. 4, except that the separated drilling fluid is returned to the surface. The separation and injection system, indicated at 71*c*, includes a diverter conduit 77*c* connected to slurry conduit 43. A screen 79*c* having a mesh size smaller than the diameter of the incompressible articles is disposed between slurry conduit 43 and diverter conduit 77*c*. Screen 79*c* separates the articles from the drilling fluid. The separated drilling fluid is returned to the surface through a return line 80 coupled to diverter conduit 77*c*.

A suitable subsurface pump 82 may be provided in return line 80 to assist in lifting the separated drilling fluid to the surface. Alternatively, gas lift or other suitable means may be provided in order to assist in lifting the drilling fluid to the surface. In the further alternative, a choke 84 may be provided adjacent the inlet of pump 81 to create a pressure drop in the flow line to riser 13, thereby enabling the separated drilling fluid to be returned to the surface by the action of the surface slurry pump 45 (FIG. 1) and without pump 82. Choke 84 is necessary in this situation; otherwise, there will not be enough pressure at the sea floor to pump the drilling fluid back to the surface due to the "u-tube" effect since the drilling fluid in return line 80 is heavier than the slurry in conduit 43.

The separated articles are concentrated at the inlet of a pump, which again in the illustrated embodiment is a Moineau pump, indicated generally at 81*c*. Preferably, the concentration of articles is maximized by balancing the flow rate of subsurface pump 82 with the liquid component flow rate of slurry pump 45. For example, if a slurry with 50% by volume of articles is pumped down conduit 43 at 800 gpm, the article flow rate is 400 gpm and the fluid flow rate is 400 gpm. If subsurface pump 82 pumps separated drilling fluid at 400 gpm, the concentration of spheres at the inlet of Moineau pump 81*c* will be substantially 100%. The space between the articles injected into riser 13 may be filled with drilling fluid diverted from riser 13 through a conduit indicated in phantom at 86 connect to the inlet of Moineau pump 81*c*.

The outlet of Moineau pump 81*c* is connected to injection point 43. Again, Moineau pump 81*c* may be powered by the fluid pumped down conduit 43 with the articles, thereby eliminating the need for separate electric or hydraulic lines from the surface. Again, while the pump of the illustrated embodiment is Moineau pump, those skilled in the art will recognize that any suitable pump, such as vane, piston, diaphragm, centrifugal, etc. pumps, may be used according to the present invention.

The weight of base mud is substantially less than that of weighted drilling fluid (e.g. 9 ppg versus 14 ppg). Base mud has the same chemistry as the weighted mud. Therefore, a small amount of base mud injected into the riser with the spheres will not contaminate the drilling fluid in riser 13.

A separated fluid return system of the type illustrated in FIG. 6 may be used with a seawater slurry system in order to satisfy any environmental concerns. In such as system, the separated seawater would be returned to the surface rather than being discharged into the ocean near the wellhead. The returned seawater could be reused to make the slurry or it could be processed prior to dumping into the ocean.

Figure 7:
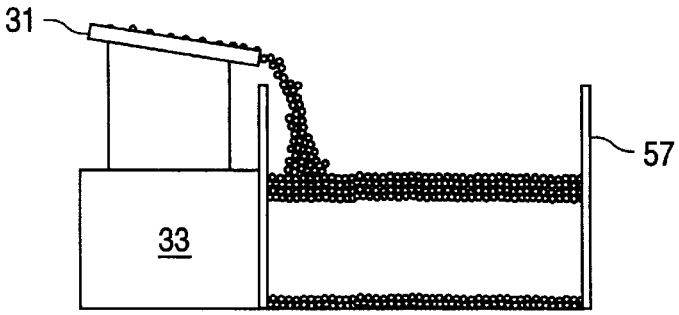
FIG. 7 illustrates a sphere recovery system according to the present invention.

Referring now to FIG. 7 there is shown details of the system for separating the drilled solids and incompressible articles from the drilling fluid. The drilling fluid returned from the riser 13 is deposited on the surface of a shale shaker 31. As is well known in the art, shale shaker 31 separates solids greater than a certain size from the drilling fluid. The separated drilling fluid flows through shale shaker 31 into drilling fluid tank 33. Separated solids, including incompressible articles and drill cuttings, travel over shale shaker 31 into tank 57. Tank 57 is partially filled with water. Accordingly, the cuttings sink and the incompressible articles float, thereby separating the incompressible articles from the drilled solids. The drilled solids are collected from the bottom of tank 57 for disposal. The incompressible articles are collected from the surface of tank 57 for re-injection into the riser.

Figure 8:
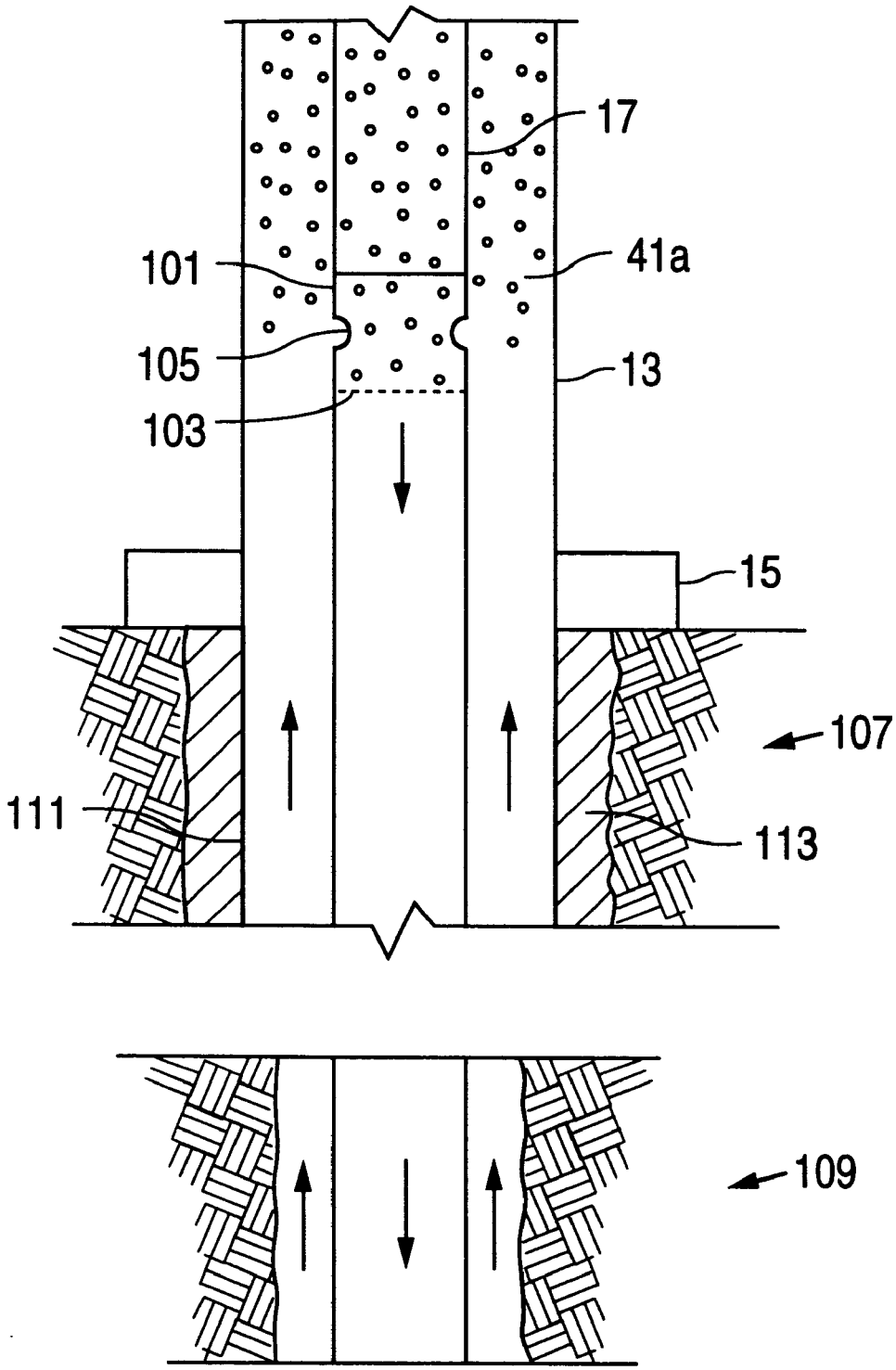
FIG. 8 illustrates an alternative system, in which the incompressible articles are injected in a primary drilling fluid slurry carried to the injection point by the drill string.

Referring now to FIG. 8, there is illustrated an alternative system in which the incompressible articles are carried to an injection point inside riser 13 in a slurry formed by the primary drilling fluid. In the system of FIG. 8, the incompressible articles are mixed with the primary drilling fluid and conveyed to an internal injection point 41*a* through drill string 17. The primary mud pump 25 (FIG. 1) pumps the slurry of incompressible articles and primary drilling fluid down the drill string to a drill string separation and injection device 101 positioned in the drill string near the depth of the seabed. Drill string separation and injection device 101 includes a tubular sub having a screen 103 and a plurality of orifices 105. Drill string separation and injection device 101 separates the incompressible articles from the drilling fluid and injects the separated articles into the riser. The separated drilling fluid continues down the drill string to the bit and back up the annulus to the riser, where it mixes with the with the incompressible articles for return to the surface. The drill string injection method does not require that the incompressible articles be separated from the drilling fluid returned to the surface.

As will be apparent from FIG. 8, the injection point may be positioned in a cased hole section, designated generally by the numeral 107, or an open hole section, designated generally by the numeral 109, of the well bore. As is well known to those skilled in the art, cased hole section 107 is defined by a casing 111 cemented into the well bore, as indicated at 113. Open hole section 109 is an uncased section of the bore hole.

By moving the injection point downwardly in the well bore, the pressure gradients in the well bore above and below the injection point can be further modified. By injecting the articles into a cased hole section, the pressure gradient in the open hole portion of the well bore can be lowered with a lower concentration of articles. By injecting the articles at multiple injection points, the pressure gradients between injection points may be adjusted to lie between the open hole fracture gradients and pore pressure gradients, thereby further reducing the number of casing sections that need to be set.

Figure 9:
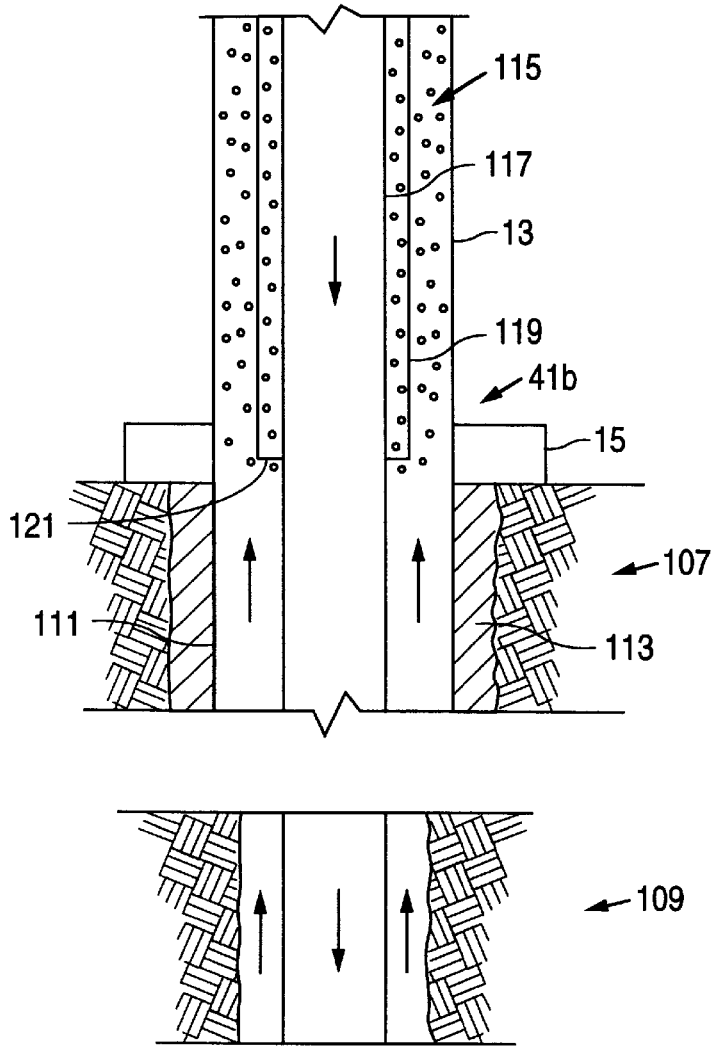
FIG. 9 illustrates an alternative system, in which the incompressible articles are carried to the injection point by a concentric drill string.

Referring now to FIG. 9, there is shown a further alternative system, in which a slurry of drilling fluid and incompressible articles is carried to an injection point 41*b* by a concentric drill pipe arrangement, designated generally by the numeral 115. Concentric drill pipe 115 includes an inner drill pipe 117, which serves the normal drill pipe functions, and an outer pipe 119, which acts as a conduit for the slurry. As shown in FIG. 9, injection point 41*b* is defined by the end 121 of outer pipe 119. As described with respect to FIG. 8, injection point 41*b* may be positioned in riser 13, cased hole section 107, or open hole section 109.

Figure 10:
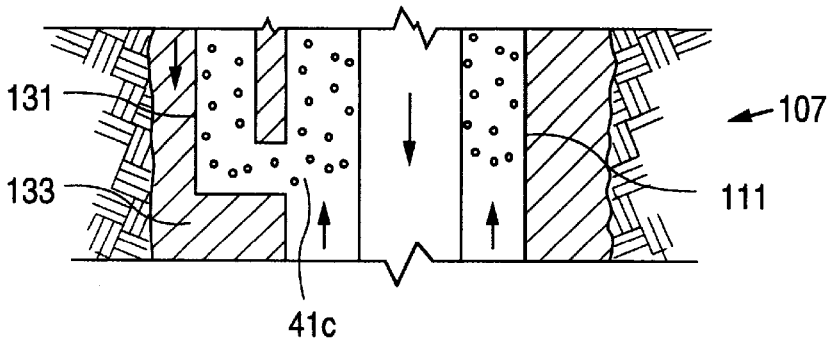
FIG. 10 illustrates an alternative system, in which the incompressible articles are carried to an injection point in a casing by a parasitic string.

Referring now to FIG. 10, there is illustrated yet a further alternative system according to the present invention. In the system of FIG. 10, a slurry of drilling fluid and incompressible articles is carried to an injection point 41*c* in a cased hole section 107 of the well bore by a parasitic string 131. Parasitic string 131 cemented into the annulus between casing 111 and the borehole wall, as indicated at 133.

In operation, incompressible buoyant articles are injected into the riser near the seafloor, preferably at a rate sufficient to reduce the density of the fluid in the riser substantially to that of seawater. The density p of the fluid in the riser is given by the equation:

$$p = \frac{(100 - v)p_f + vp_s}{100}$$

where $p_f$ is drilling fluid density without the substantially incompressible articles;

$p_s$ is the density of the substantially incompressible articles; and v is the concentration of the substantially incompressible articles.

From the equation, it may be shown that a 20% concentration by volume of 3.17 ppg spheres reduces the density of 10 ppg drilling fluid to that of seawater (8.6 ppg) whereas a 50% concentration is required to reduce the density of 14 ppg drilling fluid to that of seawater. Thus, the method and system of the present invention are clearly effective over a wide range of mud weights.

In the drilling fluid slurry (without fluid return) embodiment of the invention, the incompressible articles are pumped from drill ship 11 to the sea floor it the form of a mud slurry. The slurry pumped to the seafloor mixes with drilling fluid in the riser thereby increasing the fluid flow rate in the riser and diluting the sphere concentration. The density p of the fluid in the riser in the drilling fluid slurry embodiment is given by the equation:

$$p = \frac{p_m Q_m + p_s Q_s}{Q_m + Q_s}$$

Where $p_m$ is the drilling fluid density without the substantially incompressible articles;

$p_s$ is the density of the slurry;

$Q_m$ is the drilling fluid flow rate; and, $Q_s$ is the slurry flow rate.

When pumping 800 gpm of slurry (for example, 60% by volume of 3.17 ppg spheres in drilling fluid of the same weight as the primary drilling fluid being circulated in the borehole) into a well with drilling fluid flowing at 800 gpm, the flow rate in the riser increases to 1600 gpm and the sphere concentration decreases to about 30%. Therefore, the maximum sphere concentration that can be achieved with the drilling fluid slurry system is about 30% compared to about 50% in the seawater transfer system or the drilling fluid transfer with separated fluid return system. Accordingly, the maximum drilling fluid density with which the primary drilling fluid slurry without fluid return embodiment of the present invention can be used to reduce the density in the riser to that of seawater is about 10.3 ppg. Thus, with higher drilling fluid weights, the primary drilling fluid slurry system alone cannot reduce the density of fluid in the riser to that of seawater. Accordingly, in such instances the seawater slurry system, the lightweight drilling fluid system, or the article concentration with fluid return system should be used. Alternatively, in higher drilling fluid weight situations, the system of the present invention may be combined with other dual gradient drilling technologies, such as gas lift or subsurface pumps.

From the foregoing, it may be seen that the present invention provides a multi-gradient drilling system that overcomes the shortcomings of the prior art. Injecting incompressible buoyant articles into the riser reduces or eliminates the need for complex subsurface pumps, which can be expensive and difficult to operate. The articles can be pumped to the injection point using conventional mud pumps, thus eliminating the need for expensive compressors and nitrogen required for gas lift systems. The articles can be removed, if necesessary, from the drilling fluid returned from the well with conventional shale shakers. The articles can be injected at multiple points in the drilling fluid column to yield multiple pressure gradients, thereby further reducing the number of casing installations.

What is claimed is:

1. A system for drilling a well bore, said well bore having a bottom, into a seabed from a drilling location, which comprises:

a drilling fluid system for creating a column of drilling fluid above said bottom;

an injection system for injecting substantially incompressible articles into said column at an injection point between said bottom and said drilling location, said incompressible articles having a density less than the density of said drilling fluid; and, a separation system for separating said incompressible articles from drilling fluid returned to said drilling location from said column, said separation system returning separated drilling fluid to said drilling fluid system and separated incompressible articles to said injection system.

2. The system as claimed in claim 1, wherein said injection system includes:

a conduit connected between a surface location and said injection point.

3. The system as claimed in claim 2, wherein said injection system includes:

means for injecting a slurry comprising a fluid and said substantially incompressible articles into said conduit at said surface location.

4. The system as claimed in claim 3, wherein said fluid of said slurry comprises a drilling fluid.

5. The system as claimed in claim 4, wherein said fluid of said slurry comprises substantially unweighted drilling fluid.

6. The system as claimed in claim 3, wherein said fluid of said slurry comprises water.

7. The system as claimed in claim 3, wherein said means for injecting said substantially incompressible articles includes:

means for separating said substantially incompressible articles from said fluid of said slurry prior to injecting said substantially incompressible articles into said column; and, means for injecting separated substantially incompressible articles into said column.

8. The system as claimed in claim 7, including means for returning separated fluid to a surface location.

9. The system as claimed in claim 8, wherein said means for returning separated fluid to said surface location includes a return line.

10. The system as claimed in claim 9, wherein said means for returning separate fluid to said surface location includes means for lifting separated fluid in said return line.

11. The system as claimed in claim 7, wherein means for injecting said separated substantially incompressible articles into said column includes a pump.

12. The system as claimed in claim 7, wherein said means for separating said substantially incompressible articles includes a screen having a mesh size smaller than said substantially incompressible articles.

13. The system as claimed in claim 7, wherein said means for separating said substantially-incompressible articles includes:

a vessel, said vessel being gas-pressurized to form a water-gas interface;

a slurry inlet positioned in said vessel below said water-gas interface and coupled to said conduit;

a water outlet positioned in said vessel below said water-gas interface; and, an article outlet positioned in said vessel above said water-gas interface and coupled to said injection point.

14. The system as claimed in claim 1, wherein said separation system includes:

a screen device for separating said incompressible articles and drill cuttings from said drilling fluid.

15. The system as claimed in claim 14, wherein said screen device has a mesh size and said incompressible articles are larger than said mesh size.

16. The system as claimed in claim 14, wherein said separation system includes:

an at least partially water-filled vessel positioned to receive said incompressible articles and said drill cuttings from said screen device.

17. The system as claimed in claim 14, wherein said screen device includes a shale shaker.

18. The system as claimed in claim 1, wherein a portion of said column is defined by a riser connecting a subsea wellhead and a surface location and said injection point is positioned in said riser adjacent said wellhead.

19. The system as claimed in claim 18, wherein said substantially incompressible articles are injected into said riser at a rate sufficient to reduce the density of drilling fluid in said column above said injection point to a predetermined density.

20. The system as claimed in claim 19, wherein the density p of drilling fluid in said column is determined according to the equation $$p = \frac{(100 - v)p_f + vp_s}{100}$$

where $p_f$ is drilling fluid density without the substantially incompressible articles;

$p_s$ is the density of the substantially incompressible articles; and v is the concentration of the substantially incompressible articles.

21. The system as claimed in claim 19, wherein said substantially incompressible articles are injected into said column in a slurry comprising a mixture of substantially incompressible articles and drilling fluid the density p of drilling fluid in said riser is determined according to the equation $$p = \frac{p_m Q_m + p_s Q_s}{Q_m + Q_s}$$

Where $p_m$ is the drilling fluid density without the substantially incompressible articles;

$p_s$ is the density of the slurry;

$Q_m$ is the drilling fluid flow rate; and, $Q_s$ is the slurry flow rate.

22. The system as claimed in claim 19, wherein said predetermined density is substantially equal to the density of seawater.

23. The system as claimed in claim 1, wherein said substantially incompressible articles comprise substantially spherical articles.

24. The system as claimed in claim 23, wherein said substantially spherical articles have an outside diameter greater than about 100 microns.

25. The system as claimed in claim 1, wherein said substantially incompressible articles comprise hollow glass beads.

26. The system as claimed in claim 25, wherein hollow glass beads have an outside diameter greater than about 100 microns.

27. The system as claimed in claim 1, wherein said substantially incompressible articles comprises hollow reinforced plastic articles.

28. A method of drilling a well bore, said well bore having a bottom, into a seabed from a drilling location, which comprises the steps of:

injecting substantially incompressible articles into a column of drilling fluid at an injection point positioned between said bottom of said well bore and said drilling location, said articles having a density less than the density of said drilling fluid to create a first drilling fluid pressure gradient in said column below said injection point and a second drilling fluid pressure gradient above said injection point;

separating incompressible articles from drilling fluid returned to said drilling location from said column of drilling fluid;

injecting separated drilling fluid into said column at said bottom of said well bore; and, reinjecting separated incompressible articles into said column at said injection point.

29. The method as claimed in claim 28, wherein said step of injecting said substantially incompressible articles includes:

conveying a slurry comprising said substantially incompressible articles and a slurry fluid to said injection point.

30. The method as claimed in claim 29, wherein said step of injecting said substantially incompressible articles includes:

separating said substantially incompressible articles from said slurry fluid prior to injecting said substantially incompressible articles into said column of drilling fluid.

31. The method as claimed in claim 28, including separating said incompressible articles and drill cuttings from said drilling fluid.

32. The method as claimed in claim 31, including separating said incompressible articles from said drill cuttings.

33. The method as claimed in claim 32, wherein said step separating said incompressible articles from said drill cuttings includes:

discharging said incompressible articles and said drill cuttings into an at least partially water-filled vessel.

34. The method as claimed in claim 33, including recovering said incompressible articles from said at least partially water-filled vessel.

35. The method as claimed in claim 28, wherein said injection point is positioned in a marine riser connected between a surface drilling location and a subsea wellhead.

36. The method as claimed in claim 35, wherein said articles are conveyed to said injection point by a conduit positioned outside said riser.

37. The method as claimed in claim 35, wherein said articles are conveyed to said injection point by a conduit positioned inside said riser.

38. The method as claimed in claim 37, wherein said conduit includes a drill pipe.

39. The method as claimed in claim 28, wherein said injection point is positioned in a cased section of said well bore.

40. The method as claimed in claim 39, wherein said articles are conveyed to said injection point by a conduit positioned outside the casing of said cased section.

41. The method as claimed in claim 39, wherein said articles are conveyed to said injection point by a conduit positioned inside the casing of said cased section.

42. The method as claimed in claim 41, wherein said conduit includes a drill pipe.

43. The method as claimed in claim 28, wherein said injection point is positioned in an open hole section of said well bore.

44. The method as claimed in claim 43, wherein said articles are conveyed to said injection point by a conduit positioned in said open hole section.

45. The method as claimed in claim 44, wherein said conduit includes a drill pipe.

46. The method as claimed in claim 28, wherein the density p of drilling fluid in said column above said injection point is determined according to the equation $$p = \frac{(100 - v)p_f + vp_s}{100}$$

where $P_f$ is drilling fluid density without the substantially incompressible articles;

$p_s$ is the density of the substantially incompressible articles; and v is the concentration of the substantially incompressible articles.

47. The method as claimed in claim 28, wherein said substantially incompressible articles are injected into said column in a slurry comprising a mixture of substantially incompressible articles and a slurry fluid, and wherein the drilling fluid the density p of drilling fluid in said column above said injection point is determined according to the equation $$p = \frac{p_m Q_m + p_s Q_s}{Q_m + Q_s}$$

Where $p_m$ is the drilling fluid density without the substantially incompressible articles;

$p_s$ is the density of the slurry;

$Q_m$ is the drilling fluid flow rate; and, $Q_s$ is the slurry flow rate.

48. The method as claimed in claim 28, wherein the density of said incompressible articles is less than the density of water.

49. A system for adjusting the pressure gradient in a column of drilling fluid, which comprises:

a drilling fluid system for injecting drilling fluid into said column;

a conduit connected between a drilling location and an injection point in said column;

an injection system for injecting into said conduit a slurry comprising a mixture of substantially incompressible articles and a slurry fluid, said incompressible articles having a density less than the density of said drilling fluid;

a separation system for separating said incompressible articles and said drilling fluid returned from said column, said separation system returning separated drilling fluid to said drilling fluid system and separated incompressible articles to said injection system.

50. The system as claimed in claim 49, wherein said slurry fluid comprises a drilling fluid.

51. The system as claimed in claim 50, wherein said slurry fluid comprises substantially unweighted drilling fluid.

52. The system as claimed in claim 49, wherein said slurry fluid comprises water.

53. The system as claimed in claim 49, including:

means for separating said substantially incompressible articles from said slurry fluid prior to injecting said substantially incompressible articles into said column; and, means for injecting separated substantially incompressible articles into said column.

54. The system as claimed in claim 53, including means for returning separated slurry fluid to a surface location.

55. The system as claimed in claim 54, wherein said means for returning separated slurry fluid to said surface location includes a return line.

56. The system as claimed in claim 55, wherein said means for returning separate slurry fluid to said surface location includes means for lifting separated fluid in said return line.

57. The system as claimed in claim 53, wherein said means for injecting said substantially incompressible articles into said column includes a pump.

58. The system as claimed in claim 53, wherein said means for separating said substantially incompressible articles from said slurry fluid includes a screen having a mesh size smaller than said substantially incompressible articles.

59. The system as claimed in claim 53, wherein said means for separating said substantially incompressible articles from said slurry fluid includes:

a vessel, said vessel being gas-pressurized to form a water-gas interface;

a slurry inlet positioned in said vessel below said water-gas interface and coupled to said conduit;

a water outlet positioned in said vessel below said water-gas interface; and, an article outlet positioned in said vessel above said water-gas interface and coupled to said injection point.

60. The system as claimed in claim 49, wherein said separation system includes:

a screen device for separating said incompressible articles and drill cuttings from said drilling fluid.

61. The system as claimed in claim 60, wherein said screen device has a mesh size and said incompressible articles are larger than said mesh size.

62. The system as claimed in claim 61, wherein said separation system includes:

an at least partially water-filled vessel positioned to receive said incompressible articles and said drill cuttings from said screen device.

63. The system as claimed in claim 60, wherein said screen device includes a shale shaker.

64. The system as claimed in claim 49, wherein a portion of said column is defined by a riser connecting a subsea wellhead and a surface location and said injection point is positioned in said riser adjacent said wellhead.

65. The system as claimed in claim 64, wherein said substantially incompressible articles are injected into said riser at a rate sufficient to reduce the density of drilling fluid in said column above said injection point to a predetermined density.

66. The system as claimed in claim 65, wherein the density p of drilling fluid in said column above said injection point is determined according to the equation $$p = \frac{(100 - v)p_f + vp_s}{100}$$

where $p_f$ is drilling fluid density without the substantially incompressible articles;

$p_s$ is the density of the substantially incompressible articles; and v is the concentration of the substantially incompressible articles.

67. The system as claimed in claim 65, wherein said slurry is injected into said column and the density p of drilling fluid in said riser is determined according to the equation $$p = \frac{p_m Q_m + p_s Q_s}{Q_m + Q_s}$$

Where $p_m$ is the drilling fluid density without the substantially incompressible articles;

$p_s$ is the density of the slurry;

$Q_m$ is the drilling fluid flow rate; and, $Q_s$ is the slurry flow rate.

68. The system as claimed in claim 49, wherein the density of said incompressible articles is less than the density of water.

69. The system as claimed in claim 49, wherein said substantially incompressible articles comprise substantially spherical hollow articles.

70. The system as claimed in claim 69, wherein said substantially spherical hollow articles have an outside diameter greater than about 100 microns.

71. The system as claimed in claim 70, wherein said substantially incompressible articles comprise hollow glass beads.

72. The system as claimed in claim 49, wherein said substantially incompressible articles comprises hollow reinforced plastic articles.

73. The system as claimed in claim 49, wherein said injection point is positioned in a marine riser connected between a surface drilling location and a subsea wellhead.

74. The system as claimed in claim 73, wherein said conduit is positioned outside said riser.

75. The system as claimed in claim 73, wherein said conduit is positioned inside said riser.

76. The system as claimed in claim 75, wherein said conduit includes a drill pipe.

77. The system as claimed in claim 49, wherein said injection point is positioned in a cased section of said well bore.

78. The system as claimed in claim 77, wherein said conduit is positioned outside the casing of said cased section.

79. The system as claimed in claim 77, wherein said conduit is positioned inside the casing of said cased section.

80. The system as claimed in claim 79, wherein said conduit includes a drill pipe.

81. The system as claimed in claim 49, wherein said injection point is positioned in an open hole section of said well bore.

82. The system as claimed in claim 81, wherein said conduit is positioned in said open hole section.

83. The system as claimed in claim 82, wherein said conduit includes a drill pipe.

84. A system for drilling a well bore, said well bore having a bottom, into a seabed from a drilling location, which comprises:

a drilling fluid system for creating a column of drilling fluid above said bottom; and, a conduit connected between a surface location and an injection point between said bottom and said drilling location;

means for injecting a slurry comprising a fluid and substantially incompressible articles into said conduit at said surface location, said substantially incompressible articles having a density less than the density of said drilling fluid;

means for separating said substantially incompressible articles from said fluid of said slurry prior to injecting said substantially incompressible articles into said column; and, means for injecting separated substantially incompressible articles into said column.

85. A method of drilling a well bore, said well bore having a bottom, into a seabed from a drilling location, which comprises the steps of:

creating a column of drilling fluid between said bottom of said well bore and said drilling location;

conveying a slurry comprising substantially incompressible articles and a slurry fluid to an injection point positioned in said column between said bottom of said well bore and said drilling location, said substantially incompressible articles having a density less than the density of said drilling fluid;

separating said substantially incompressible articles from said slurry fluid at a position adjacent said injection point;

injecting said separated substantially incompressible articles into said drilling fluid column to create a first drilling fluid pressure gradient in said column below said injection point and a second drilling fluid pressure gradient above said injection point.

86. A system for adjusting the pressure gradient in a column of drilling fluid, which comprises:

a conduit connected between a drilling location and an injection point in said column;

a system for injecting into said conduit a slurry comprising a mixture of substantially incompressible articles and a slurry fluid, said incompressible articles having a density less than the density of said drilling fluid;

means for separating said substantially incompressible articles from said slurry fluid at a position adjacent said injection point; and, means for injecting separated substantially incompressible articles into said column.

* * * * *